US006612289B1

(12) United States Patent
Frank et al.

(10) Patent No.: US 6,612,289 B1
(45) Date of Patent: Sep. 2, 2003

(54) COMMON RAIL AND METHOD FOR PRODUCING A COMMON RAIL

(75) Inventors: Kurt Frank, Schorndorf (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/868,313

(22) PCT Filed: Oct. 13, 2000

(86) PCT No.: PCT/DE00/03606

§ 371 (c)(1),
(2), (4) Date: Oct. 22, 2001

(87) PCT Pub. No.: WO01/29405

PCT Pub. Date: Apr. 26, 2001

(30) Foreign Application Priority Data

Oct. 16, 1999 (DE) ..... 199 49 962

(51) Int. Cl.[7] ..... F02M 41/00
(52) U.S. Cl. ..... 123/456; 123/468
(58) Field of Search ..... 123/468, 469, 123/472, 456, 470, 467

(56) References Cited

U.S. PATENT DOCUMENTS 5,027,777 A * 7/1991 De Bruyn et al. ..... 123/468
5,513,613 A * 5/1996 Taylor et al. ..... 123/456
5,775,302 A * 7/1998 Guido et al. ..... 123/468
6,126,208 A * 10/2000 Asada et al. ..... 285/133.4
6,186,119 B1 * 2/2001 Ciecko ..... 123/456
6,196,192 B1 * 3/2001 Ciecko ..... 123/456

FOREIGN PATENT DOCUMENTS

DE 1 98 08 894 A1 9/1998
EP 0449662 A1 * 10/1991

* cited by examiner

*Primary Examiner*—Carl S. Miller
(74) *Attorney, Agent, or Firm*—Ronald E. Greigg

(57) ABSTRACT

The invention relates to a common rail for a common rail fuel injection system of an internal combustion engine, and to a method of making such a common rail, having a hollow base body that is equipped with a plurality of connection openings. To enhance the high-pressure strength, the interior of the base body is embodied as substantially flat in the region of the connection openings.

8 Claims, 1 Drawing Sheet

COMMON RAIL AND METHOD FOR PRODUCING A COMMON RAIL

CROSS-REFERENCE TO RELATED APPLICATIONS

This application is a 35 USC 371 application of PCT/DE 00/03606 filed on Oct. 13, 2000.

BACKGROUND OF THE INVENTION

1. Field of the Invention

The invention relates to a common rail for a common rail fuel injection system of an internal combustion engine, having a hollow base body that is equipped with a plurality of connection openings, and to a method for producing such a common rail.

2. Description of the Prior Art

In common rail injection systems, a high-pressure pump, optionally with the aid of a prefeed pump, pumps the fuel that is to be injected from a tank into the central high-pressure fuel reservoir, which is called a common rail. From the rail, fuel lines lead to the individual injectors that are assigned to the engine cylinders. The injectors are triggered individually the engine electronics, as a function of the engine operating parameters, in order to inject fuel into the combustion chamber of the engine. By means of the common rail, the pressure generation and the injection are decoupled from one another.

A conventional common rail is described for instance in German Patent Disclosure DE 195 48 611. The conventional common rails withstand pressures of up to about 1100 bar.

SUMMARY AND OBJECTS OF THE INVENTION

The primary object of the invention is to increase the high-pressure strength of the known common rail by simple provisions.

In a common rail for a common rail fuel injection system of an internal combustion engine, having a hollow base body that is equipped with a plurality of connection openings, this object is attained in that the interior of the base body is embodied as flat in the region of the connection openings. Within the context of the present invention, it has been found that the high-pressure strength of the common rail is limited primarily by the intersections between the connection openings and the base body. In operation, peak stresses that can lead to the development of cracks in the base body occur in the intersection region. By the provision according to the invention, the high-pressure strength of the common rail is increased without substantially increasing its structural volume. The interior of the base body can have a cylindrical or spherical geometry, for instance.

One particular embodiment of the common rail of the invention is attained in that a connection stub is embodied on the base body and has a connection bore whose center line is disposed perpendicular to an internal flat face in the region of the connection opening. This offers the advantage that the peak stresses in the intersection region are minimized.

A common rail for a common rail fuel injection system of an internal combustion engine, having a tubular base body that is equipped with a plurality of connection openings, achieves the above-stated object in that the inside diameter of the tubular base body is widened in the region of the connection openings. The pressure strength of the common rail increases if the ratio between the inside diameter of the base body and the inside diameter of the connection openings is selected to be as great as possible. The local widening of the inside diameter of the base body leads to an increase in this diameter ratio in the critical region of the connection openings, without increasing the external dimensions of the common rail of the invention.

A common rail for a common rail fuel injection system of an internal combustion engine, having a tubular base body that is equipped with a plurality of connection openings attains the above-stated object in that the interior of the tubular base body is embodied as flat in the region of the connection openings. This means that the inside diameter of the tubular base body assumes the value of "infinite" in the region of the connection openings. This provision leads to the maximum high-pressure strength of the common rail of the invention, at a minimized structural volume. The connection openings are as a rule formed by radial bores, whose center lines are each disposed perpendicular to the flat face in the region of the connection openings.

In a method for producing a common rail as described above, the above-stated object is attained in that the tubular base body is deformed inward in the region of the connection openings in such a way that it protrudes inward, and that the inward-protruding region is machined in a way that removes material, in order to widen the inside diameter of the tubular base body in the region of the connection openings. By this means, in a simple way, local widening of the inside diameter of the base body only in the region of the connection openings is achieved.

A particular embodiment of the method of the invention is characterized in that the interior of the tubular base body is machined in the region of the connection openings with the aid of an electrochemical removal method (ECM, for Electrochemical Machining). The use of this method has proved itself in practice to be especially advantageous.

BRIEF DESCRIPTION OF THE DRAWINGS

Further objects and advantages of the invention will become apparent from the ensuing description, taken in conjunction with the drawings, in which.

DESCRIPTION OF THE PREFERRED EMBODIMENTS

Figure 1:
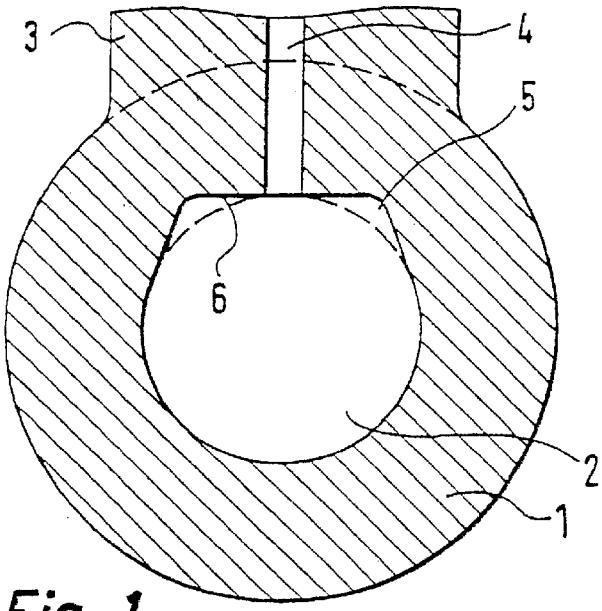
FIG. 1 is a sectional view of a first embodiment of a common rail of the invention.

The common rail shown in cross section in FIG. 1 includes a tubular base body 1. A longitudinal bore 2 in the tubular base body 1 forms the storage volume. A connection stub 3 is embodied on the tubular base body 1 and in it, a connection bore 4 extends transversely to the longitudinal axis of the tubular base body 1. The connection bore 4 discharges into the longitudinal bore.

A region 5 of the tubular base body 1 has been removed with the aid of a material-removing machining process. In this way, a flat face 6 has been created in the discharge region of the connection bore 4. The flat face 6 extends perpendicular to the center line of the connection bore 4. The contour of the cylindrical interior of the tubular base body 1 is suggested by dashed lines in FIG. 1.

Figure 2:
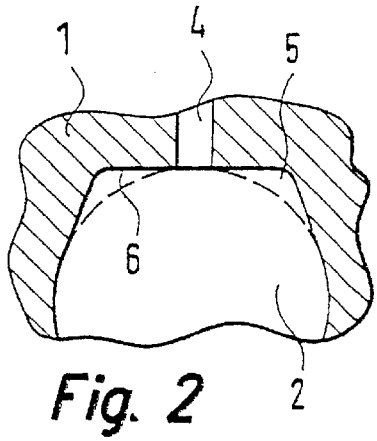
FIG. 2 is a detail of FIG. 1 for a second embodiment of the invention.

In FIG. 2, a detail of a second embodiment of a common rail of the invention is shown in cross section. As in the embodiment shown in FIG. 1, there is a longitudinal bore 2 in a tubular base body 1. A connection bore 4 discharges into the longitudinal bore 2. In the region where the connection bore 4 discharges into the longitudinal bore 2, there is a block-shaped recess 5 in the tubular base body 1. In the interior of the base body 1, this creates a flat face 6, which extends perpendicular to the center line of the connection bore 4.

Figure 3:
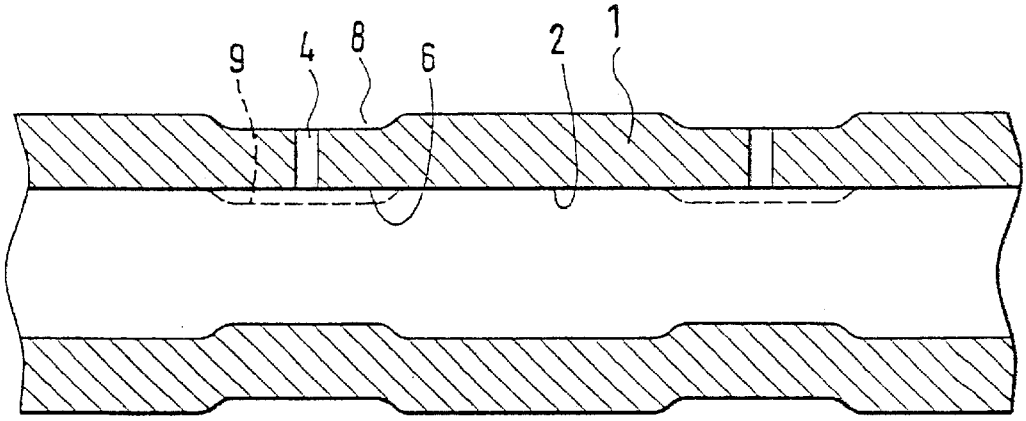
FIG. 3 is a third embodiment of a common rail of the invention in longitudinal section.

In FIG. 3, a longitudinal section is shown through a third embodiment of a common rail of the invention. The common rail shown in FIG. 3 includes a tubular base body 1. A longitudinal bore 2 is disposed in the tubular base body 1. A radial connection bore 4 discharges into the longitudinal bore 2.

The region 8, surrounding the connection bore 4, of the outer jacket face of the tubular base body 1 is indented with the aid of a suitable tool over the entire circumference of the tubular base body 1. The deformation of the outer jacket face of the tubular base body 1 causes an annular region 9, shown in dashed lines in FIG. 3, to protrude into the interior of the tubular base body 1. The protruding region 9 is removed in the discharge region of the connection bore 4 in such a way that a flat face 6 is created.

Figure 4:
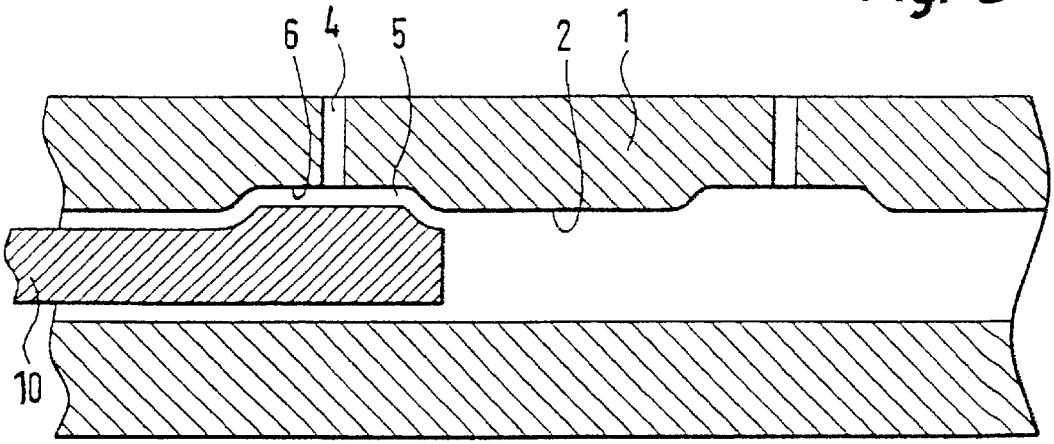
FIG. 4 is a longitudinal section through a common rail of the invention with a machining tool introduced.

In FIG. 4, a fourth embodiment of a common rail of the invention is shown in longitudinal section. The common rail shown in FIG. 4 includes a tubular base body 1. A longitudinal bore 2 is recessed out of the tubular base body 1. A radial connection bore 4 discharges into the longitudinal bore 2.

To remove the region 5 in the interior of the base body 1, an ECM electrode is introduced into the longitudinal bore 2. With the aid of the ECM electrode 10, the material of the tubular base body 1 is removed in the region 5. In the discharge region of the connection bore 4, this creates a flat face 6.

Electrochemical removal, also called elysing, is a removal method in which metal material is anodically broken up under the influence of an electric current and an electrolyte solution. The current flow can be accomplished by an external current source or by local element formation at the workpiece (internal voltage source). The operating principle of anodic metal dissolution is based on electrochemical reactions, in which metal ions change from the metal phase to the electrolyte phase or a reaction product phase. These reactions are set in motion by charge exchange events and obey the internal kinematics of a galvanic element.

In the present invention, the operative inside diameter of the tubular base body 1 at the intersection between the longitudinal bore 2 and the connection bore 4 is widened locally, or in other words made locally as large as possible, without the common rail of the invention assuming extreme external dimensions. In this way, maximum high-pressure strength with a minimized structural volume is attained.

The foregoing relates to preferred exemplary embodiments of the invention, it being understood that other variants and embodiments thereof are possible within the spirit and scope of the invention, the latter being defined by the appended claims.

We claim:

1. A common rail for a common rail fuel injection system of an internal combustion engine, the common rail comprising a hollow base body (1) having a plurality of connection openings (4), the interior of said base body (1) having a flat surface in the region of said connection openings (4), wherein the interior of the hollow base body has a recess formed at each of the connection openings, and each of the flat surfaces are formed in one of these recesses.

2. The common rail of claim 1, further comprising a connection stub (3) on the base body (1) said connecting stub having a connection bore (4) whose center line is disposed perpendicular to said flat face (6) in the region of the connection opening (4).

3. A common rail for a common rail fuel injection system of an internal combustion engine, the common rail comprising a tubular base body (1) having a plurality of connection openings (4), the inside diameter of said tubular base body (1) being widened in the region of the connection openings (4), wherein the interior of the tubular base body has a recess formed at each of the connection openings, and each of the areas of the interior of the base body which is widened are formed in one of these recesses.

4. A common rail for a common rail fuel injection system of an internal combustion engine, the common rail comprising a tubular base body (1) having a plurality of connection openings (4), the interior of said tubular base body (1) including a flat area in the region of the connection openings (4), wherein the interior of the tubular base body has a recess formed at each of the connection openings, and each of the flat surfaces are formed in one of these recesses.

5. A method for producing a common rail as defined in claim 3, comprising deforming said tubular base body inward in the region of said connection openings, and machining the inwardly deformed regions to remove material therefrom to thereby widen the inside diameter of the tubular base body in the region of the connection openings.

6. A method for producing a common rail as defined in claim 4, comprising deforming said tubular base body inward in the region of said connection openings, and machining the inwardly deformed region to remove material therefrom to thereby produce said flat surface in the region of said connecting opening.

7. A method for producing a common rail as defined in claim 3, comprising the step of widening the inside diameter of said tubular base in the region of said connector openings by a process including an electrochemical removal step.

8. A method for producing a common rail as defined in claim 4, comprising the step of producing said flat area in the region of said connection openings with the aid of an electrochemical removal method.

* * * * *